US006082106A

United States Patent [19]

Hamamoto

[11] Patent Number: 6,082,106

[45] Date of Patent: Jul. 4, 2000

[54] HYDRAULIC DEVICE

[75] Inventor: Satoshi Hamamoto, Toyama-ken, Japan

[73] Assignee: Nachi-Fujikoshi Corp., Toyama, Japan

[21] Appl. No.: 09/174,842

[22] Filed: Oct. 19, 1998

[30] Foreign Application Priority Data

Oct. 17, 1997 [JP] Japan ..... 9-299681

[51] Int. Cl.[7] ..... F15B 11/05

[52] U.S. Cl. ..... 60/422; 60/426; 91/446; 91/517

[58] Field of Search ..... 60/422, 426; 91/446, 91/447, 517

[56] References Cited

U.S. PATENT DOCUMENTS

| | | | |
|---|---|---|---|
| 4,020,867 | 5/1977 | Sumiyoshi | 91/446 |
| 4,275,643 | 6/1981 | Knowles | 91/446 |
| 5,271,227 | 12/1993 | Akiyama et al. | 60/422 |
| 5,347,811 | 9/1994 | Hasegawa et al. . | |
| 5,622,206 | 4/1997 | Takeuchi et al. . | |
| 5,738,134 | 4/1998 | Ishizaki et al. | 91/446 |

FOREIGN PATENT DOCUMENTS

| | | |
|---|---|---|
| 5-172112 | 7/1993 | Japan . |
| 5-332310 | 12/1993 | Japan . |
| 5-332311 | 12/1993 | Japan . |
| 7-324355 | 12/1995 | Japan . |
| 8-254201 | 10/1996 | Japan . |

*Primary Examiner*—F. Daniel Lopez
*Attorney, Agent, or Firm*—Venable; Robert J. Frank; Gabor J. Kelemen

[57] ABSTRACT

A hydraulic device comprises a variable displacement pump, a plurality of hydraulic actuators, a plurality of directional valves capable of controlling the delivery oil flowing into each of the actuators, a plurality of pressure compensation valves which compensate the pressures of respective directional valves, and a delivery oil flow rate varying means capable of controlling the pump delivery. At least one of the pressure compensation valves decreases its output flow to a particular actuator according to an increase in the loaded pressure of the particular actuator. With this arrangement, if the loaded pressure of the particular actuator suddenly changes, the loaded pressure attenuates to ensure stable operation of the hydraulic device. Further, the stable operation is fee of hunting for both low-load actuators and high load actuators, regardless of an independent operation or a compound operation.

12 Claims, 8 Drawing Sheets

HYDRAULIC DEVICE

BACKGROUND OF THE INVENTION

1. Field of the Invention

The present invention relates to a hydraulic device used for a hydraulic excavator for a construction machine or the like. The hydraulic device is adapted for controlling the delivery oil from one or more hydraulic pump(s) which flows into and drives both at least one actuator having an excessively higher inertial load and at least one actuator having a relatively low inertial load at the same time.

2. Description of the Related Art

This type of hydraulic device is employed primarily for construction machinery and agricultural machinery. It is equipped with a load-sensing required-stream regulation function for controlling the delivery of the variable displacement pump according to loaded pressure. Further, the circuits connected to actuators are provided with pressure compensation valves to divide the pump delivery so as to prevent the respective actuators from interfering with each other due to the difference in loaded pressures, etc. among the respective actuators with a resultant change in speed of the actuators when driving the plurality of actuators at the same time. Furthermore the hydraulic devices are equipped with a function known as an anti-saturation function for distributing pump delivery to the individual actuators at an appropriate ratio when the pump delivery is smaller than a predetermined required flow of the plurality of driven actuators.

A first such conventional hydraulic device is shown in FIG. 5 which is disclosed, for instance, in U.S. Pat. No. 5,347,811, Japanese Publication No. 05172112; 08254201. In FIG. 5, a so-called 'after-orifice type' hydraulic device having a load-sensing function is shown which comprises first and second actuators 12,13 and first and second directional valves 14,15 each having flow control function capable of controlling the pump delivery oil from a variable delivery pump 2 flowing into each of the actuators, respectively, and first and second pressure compensation valves 50,51 coupled to and for compensating pressures of the first and second directional valves 14, 15, respectively. Each pressure compensation valve 50,51 located between the actuator and the directional valve both communicating with the pressure compensation valve receives an oil pressure on a downstream side of a throttle of the directional valve coupled to the pressure compensation valve to act in a first control pressure chamber 50*a*,51*a* to open the pressure compensation valve and a maximum loaded pressure of the loaded pressures of the hydraulic actuators of the hydraulic device to act in a second control pressure chamber 50*b*, 51*b* to close the pressure compensation valve, and a pressure receiving area of each control pressure chamber 50*a*,51*a*, 50*b*,51*b* is made nearly equal with each other.

With this arrangement, on condition that the amount of the delivery oil flow to be supplied to each actuator 12,13 is relatively small and the total amount to be supplied to each actuators does not reach to the maximum delivery flow rate of the pump 2, a differential pressure across each directional valve 14,15 across its throttle becomes equal to the differential pressure between the pump delivery pressure Pp and the maximum loaded pressure Pm among the actuators, that is, equal to the pre-set differential pressure being set by the spring 18 of the pump flow control valve 17. Therefore, even if the load pressures of the actuators 12,13 may differ from each other, each differential pressure across each directional valve will not be affected by the load pressure of each actuator, thereby the amount of the delivery oil flow to be supplied to each actuator 12,13 is determined by an amounts of the openings of the throttles of the directional valves and the pre-set differential pressure being set by the spring 18, and performs a load-sensing function to keep a pre-set speed control of the actuators. Further, the maximum pressure Pm of the actuators is introduced to the pump flow control valve 17 to drive the displacement varying means 6 coupled to the pump 2, so that the differential pressure between the pump delivery pressure Pp and the maximum loaded pressure Pm is controlled to be equal to the pre-set differential pressure being set by the spring 18.

In FIG. 5, assuming that the first actuator 12 being for a swing motor for a cab for a hydraulic excavator of a construction machine having a high inertial load, and the second actuator 13 being for a boom cylinder having a low-load, and these actuators are simultaneously operated. Firstly, control levers of the directional valves 12,13 are moved by certain strokes to operate the actuators. These strokes are usually of long and full or nearly full ones. Then, the delivery oil from the pump 2 flows into the actuators 12,13 through the directional valve 14,15 to move the actuators. However, since the actuator 12 has the high inertia, the actuator 12 does not immediately move, thus causing a loaded pressure of one of the inlet ports 12*a*,12*b* to rise momentarily. An excessive rise in the loaded pressure of the one of the inlet ports exceeding a relief-setting pressure of the overload relief valves (not shown) connected to the lines of the inlet ports 12*a*,12*b*, further causes a rise of the loaded pressure of the one of the relief valve, thereby almost of the delivery oil flowing into the one of the inlet port is exhausted through the relief valve into a tank T.

At the same time, since the loaded pressure exceeding over the relief-setting pressure is introduced, by way of the load-sensing function, to the pump flow control valve 17 through a shuttle valve 4 via line 5 to act the pump flow control valve 17 to increase pump delivery oil. On the other hand, when the delivery oil pressure of the pump 2 rises to a predetermined setting pressure of a constant power output regulation valve 19, the valve 19 take precedence over the pump flow control valve 17 to decrease the delivery oil from the pump 2 through the auto-constant power output regulation function.

While the constant power output regulation valve 19 is acting to decrease the delivery oil from the pump 2, the above mentioned 'anti-saturation function' for distributing pump delivery to the individual actuators at an appropriate ratio when the pump delivery is smaller than a predetermined required flow of the plurality of driven actuators, works to act on the pressure compensation valve to keep each oil pressures on the upstream side lines 7 and 7 of the pressure compensation valves 50,51 to be equal. This results that each opening of the throttles of each pressure compensation valve is made smaller and the delivery oil flows through the pressure compensation valves will decrease. Therefore, the speed of the boom cylinder 13 becomes extremely slower than that of when the boom cylinder 13 is independently operated, causing the boom cylinder operation such as a loading on a truck excessively difficult, deteriorates the working efficiencies and increases the operator's fatigue. At the same time, a problem occurs that the delivery oil flow flowing into the actuator 12 for the swing motor and then exhausted through the overload relief valve into the tank causes a large energy loss of the engine 1.

Secondly, when actuator 12 for the swing motor loses the acceleration and reaches to a constant speed operation, the torque of the swing motor suddenly decreases, then the loaded pressure of the actuator 13 for boom cylinder becomes higher than that of the actuator 12 by the lowering of its loaded pressure. This causes the maximum loaded pressure Pm of the hydraulic actuators on the line 5 suddenly drops and thereby results a drop of the line pressure on the pump delivery line 3 and increases the pump delivery oil through the easing of the operation of the constant power output regulation valve 19, resulting that the speed of the actuator 13 for boom cylinder is suddenly accelerated, and as a whole, the actuators 12,13 do not work smoothly during the simultaneous operations of these actuators 12,13.

To cope with these problems of the first conventional hydraulic device shown in FIG. 5, U.S. Pat. No. 5,347,811 and the Japanese Publication No. 08254201, for example, propose a hydraulic device wherein a downstream line of a pressure compensation valve for an actuator for a swing motor and an inlet port of an actuator for extending the actuator for the boom cylinder is communicated with each other via a joinning line , and th ere a re pro vided on the joining line in series a pilot operate shut-off valve and a check valve allowing a flow to the inlet port from a downstream line of the pressure compensation valve for the swing motor. In operation, in accordance with the amount of the strokes of the directional valves, a pilot pressure of the directional valve for the boom cylinder is introduced to open the shut-off valve and the check valve in series, thereby the maximum loaded pressure on a downstream line of the pressure compensation valve for the swing motor flows into the inlet port of the actuator for extending the boom cylinder. This prevents an abrupt rise of the load pressure of the actuator for the swing motor and at the same time prevents the lowering of the extending speed of the boom cylinder.

However, to prevent both the abrupt rise of the load pressure of the actuator for the swing motor and the lowering of the extension speed of the boom cylinder, the aforementioned U.S. Pat. No. 5,347,811 and the Publication No. 08254201 must provide beside the conventional pressure compensation valves the additional valves, such as the pilot operate shut-off valve, the check valve, and the external pilot lines providing pilot pressures to operate these additional valves at a predetermined condition. Therefore, the additional valves and the external pilot lines naturally make total valve block and hydraulic system bulky, complicated and of high cost. Further, since these additional valves operates at the predetermined condition, an additional problem occurs that the boom cylinder makes a discontinuous movement.

The above-mentioned problems of the first conventional hydraulic device shown in FIG. 5 similarly occur in a second conventional hydraulic device shown in FIG. 6 which is disclosed, for example, in the Japanese Publication No. 07324355. In FIG. 6, a hydraulic circuit for a hydraulic device having both the anti-saturation function and the load-sensing function is shown comprising first and second directional valves 24,25 disposed in parallel each having flow control function capable of controlling the pump delivery oil from a variable displacement pump 2 flowing into each of actuators 12,13 via a pump line 3 and check valves 26,27, respectively. First and second pressure compensation valves 60,61 for compensating pressures of the first and second directional valves 24,25 are located on downstream sides of the directional valves 24,25 before a tank T, respectively. Each return oil flowing from the actuators 12,13 is exhausted via the directional valve 24, 25, the pressure compensation valve 60, 61 and tank line 16 to the tank T. Each pressure compensation valve 60,61 receives an oil pressure communicated with a loaded pressure of the actuator communicating with the pressure compensation valve to act in a first control pressure chamber 60*a*,61*a* to open the pressure compensation valve, and a maximum loaded pressure of the loaded pressures of the hydraulic actuators of the hydraulic device to act in a second control pressure chamber 60*b*,61*b* to close the pressure compensation valve, respectively. A pressure receiving area of each control pressure chamber 60*a*,61*a*,60*b*,61*b* is made nearly equal. By such an arrangement, this second conventional hydraulic device shown in FIG. 6 performs similar operations and has the same problems as described in the first conventional hydraulic device shown in FIG. 5.

To cope with these problems of the second conventional hydraulic device shown in FIG. 6, the Japanese Publication No. 07324355, for example, proposes a hydraulic device wherein, adding to the hydraulic circuit shown in FIG. 6, a bypass pump delivery oil line communicating with the tank is provided in parallel to the directional valves, and a bleed-off valve and a pressure generating device are provided in the bypass pump delivery oil line in series. And a pressure on an upstream side of the pressure generating device is introduced to the pump displacement varying means coupled to the variable displacement pump to perfrom a so-called a negative control. Further, a maximum pressure of all actuators is adapted to act only on the pressure compensation valve coupled to the actuator for a swing motor and on the bleed-off valve to close the pressure compensation valve and the bleed-off valve, while a maximum pressure of actuators other than for a swing motor having a relatively low load is adapted to act only on the pressure compensation valves coupled to the actuators other than for the swing motor having a relatively low load to close the pressure compensation valves, thereby the pressure compensation valves coupled to the actuators other than for the swing motor are prevented from closing the pressure compensation valves by an excessive high loaded pressure of the swing motor and are prevented from decreasing the moving speed of the actuators other than for the swing motor having a relatively low load. However, the above addition of the additional valve and the pilot lines to operate the pressure compensation valves for the boom cylinders naturally make the hydraulic circuit complicated and total valve blocks bulky, and of high cost. Furthermore, when actuator for the swing motor loses the acceleration and reaches to a constant speed operation, the load of the swing motor suddenly decreases, then the loaded pressure of the actuator for boom cylinder becomes higher which causes the pressure compensation valves for the actuator for the swing motor to close by the high loaded pressure of the actuator for boom cylinder, resulting the sudden lowering of the swing speed of the actuator for the swing motor.

The above-mentioned problems of the first conventional hydraulic device shown in FIG. 5 similarly occur in a third conventional hydraulic device shown in FIGS. 7 and 8 which is disclosed, for example, in U.S. Pat. No. 5,622,206, and Japanese Publication No. 05332310; 05332311. In FIG. 7, a hydraulic device is shown which comprises pressure compensation valves 70,71 located between pump lines 3 and directional valves 24,25 communicating with the pressure compensation valves 70, 71, respectively. Each pressure compensation valve 70, 71 is integrally formed with a check valve portion 76, 78 which normally blocks the reverse flow from the actuator to the pump lines 3 and throttles the pump delivery oil flowing into the actuator, and a reducing valve portion 77,79 having a reducing valve spool 72 contactable to close the check valve spool 74 of the check valve portion 76,78 and capable of reducing a pressure of the pump delivery oil on the pump lines 3 to a loaded pressure of the actuator communicating with the reducing valve portion 77,79, respectively. And each pressure compensation valve 70,71 receives an oil pressure on a downstream side of a throttle of the directional valve 24,25 coupled to the pressure compensation valve to act in a first control pressure chamber 77*a*, 79*a* of the pressure compensation valve to open the pressure compensation valve, a maximum loaded pressure of the loaded pressures of the hydraulic actuators of the hydraulic device to act in a second control pressure chamber 77*b*,79*b* of the pressure compensation valve to close the pressure compensation valve, respectively. A pressure receiving area of each control pressure chamber 77*a*,79*a*,77*b*,79*b* is made nearly equal. FIG. 8 is a schematically cross sectional block view of one of the pressure compensation valves 70,71 shown in FIG. 7. By such an arrangement, this third conventional hydraulic device shown in FIG. 7 performs similar operations and has the same problems as described in the first conventional hydraulic device shown in FIG. 5.

To cope with these problems of the third conventional hydraulic device shown in FIG. 7, to prevent the lowering of the extension speed of the boom cylinder having a relatively low inertial load, the Japanese Publication No. 05332311, for example, proposes a hydraulic device wherein, beside the conventional pressure compensation valves and the directional valves, a pilot check valve is provided which opens by an introduction of a pilot pressure on a pilot pressure line adapted to move the spool of a directional valve 25 communicated with an actuator 13 for a boom cylinder having the relatively low inertial load. The pilot check valve is located before the reducing valve portion 77 communicated with the actuator 12 for the swing motor, and thus prevents an introduction of the pump delivery oil to the reducing valve portion 77 communicated with the actuator 12 for the swing motor, thereby prevents both the abrupt rise of the load pressure of the actuator for the swing motor and the lowering of the extension speed of the boom cylinder.

However, the Japanese Publication No. 05332311 must provide beside the conventional pressure compensation valves the additional valve such as the pilot operate check valve, and the pilot line to operate the pilot operate check valve. Therefore, the additional valves and the pilot line naturally make the hydraulic circuit complicated and total valve blocks are bulky, and of high cost.

SUMMARY OF THE INVENTION

The present invention has been made in view of the problems with the prior art and it is an object of the present invention to provide a hydraulic device having a pressure compensation valve which is capable of supplying sufficient pressure oil to at least one low load actuator when at least one actuator having extremely high-load is operated at the same time with the one of the low-load actuator and ensuring a smooth operation free of a shock without causing a sudden change in a speed of the one of the low-load actuator even if a loaded pressure of the one of the high-loaded actuator suddenly drops.

Another object of the present invention is to provide a hydraulic device which prevents an excessive energy loss resulting from the exhauste oil from overload relief valves and protects an engine of the construction machine.

It is still another object of the present invention to provide a hydraulic device which, beside the pressure compensation valves, no additional valve and the pilot line is required, resulting a simple and of low cost.

To these ends, according to a first aspect of the present invention, there is provided a hydraulic device comprising:

a first hydraulic actuator having a high-load and a second hydraulic actuator having a low-load, each actuator being driven by delivery oil;

first and second directional valves having flow control function capable of controlling the delivery oil flowing into each of the actuators, respectively;

first and second pressure compensation valves coupled to and for compensating pressures of the first and second directional valves, respectively, each pressure compensation valve receives an oil pressure on a downstream side of a throttle of the directional valve coupled to the pressure compensation valve, a maximum loaded pressure of the loaded pressures of the hydraulic actuators of the hydraulic device, and an oil pressure communicated with a loaded pressure of the actuator communicating with the pressure compensation valve, such that the oil pressure on the downstream side of the throttle of the directional valve to act in a first control pressure chamber of the pressure compensation valve to open the pressure compensation valve, and a maximum loaded pressure to act in a second control pressure chamber of the pressure compensation valve to close the pressure compensation valve, and the oil pressure communicated with a loaded pressure of the actuator communicated with the pressure compensation valve to act in a third control pressure chamber of the pressure compensation valve to close the pressure compensation valve, further, each pressure receiving area of the first and second control pressure chambers is made nearly the same, while the pressure receiving area of the third control pressure chamber is made far smaller than that of the first control pressure chamber, thereby the pressure compensation valve decreasing flow of the delivery oil to the respective actuator when the loaded pressure of the actuator communicating with the pressure compensation valve is increased;

a variable displacement pump for pumping the delivery oil to the first and second actuators;

a constant power control means coupled to the variable displacement pump; and a delivery oil flow rate varying means associated with the constant power control means.

Preferably, in the hydraulic device according to the first aspect of the present invention, a rate of the decreasing output flow of the delivery oil of one of the pressure compensation valves communicating with one of the actuators having a high-load is made greater than that of the one of the pressure compensation valves communicating with the one of the actuators having a low load.

More preferably, in the hydraulic device according to the first aspect of the present invention, a value obtained by dividing the pressure receiving area of the third control pressure chamber by the pressure receiving area of the first control pressure chamber of the one of the pressure compensation valves communicating with the one of the actuators having a high-load ranges from 0.03 to 0.07, while a value obtained by dividing the pressure receiving area of the third control pressure chamber by the pressure receiving area of the first control pressure chamber of the one of the pressure compensation valves communicating with one of the actuators having a low-load ranges from 0 to 0.02.

According to a second aspect of the present invention, there is provided a hydraulic device comprising:

a first hydraulic actuator having a high-load and a second hydraulic actuator having a low-load, each actuator being driven by delivery oil from the pump;

first and second directional valves having flow control function capable of controlling the delivery oil flowing into the first and second actuators, respectively;

first and second pressure compensation valves coupled to and for compensating pressures of the first and second directional valves and located between the directional valve communicating with the pressure compensation valve and a tank, respectively, each pressure compensation valve receives an oil pressure on the downstream side of a throttle of the directional valve coupled to the pressure compensation valve, and a maximum loaded pressure of the loaded pressures of the hydraulic actuators of the hydraulic device, respectively, such that the oil pressure on a downstream side of the throttle of the directional valve to act in a first control pressure chamber of the pressure compensation valve to open the pressure compensation valve, and the maximum loaded pressure to act in a second control pressure chamber of the pressure compensation valve to close the pressure compensation valve, respectively, further, a value obtained by dividing the pressure receiving area of the first control pressure chamber by the pressure receiving area of the second control pressure chamber of the pressure compensation valve communicating with the first hydraulic actuator having the high-load, ranges from 0.93 to 0.97, while a value obtained by dividing the pressure receiving area of the first control pressure chamber by the pressure receiving area of the second control pressure chamber of the pressure compensation valve communicating with the second hydraulic actuator having the low-load, ranges from 0.98 to 1.00, thereby the rate of the decreasing flow of the delivery oil to actuator having the high-load when the loaded pressure of the pressure compensation valve communicating with the high-load actuator is increased is made greater than that of the pressure compensation valve communicating with the actuator having the low-load, a variable displacement pump for pumping the delivery oil to the first and second actuators;

a constant power control means coupled to the variable displacement pump; and a delivery oil flow rate varying means associated with the constant power control means.

With these arrangements according to the first and second aspects of the present invention, since a rate of the decreasing output flow of the delivery oil of one of the pressure compensation valves communicating with one of the actuators having a high-load is made greater than that of the one of the pressure compensation valves communicating with the one of the actuators having a low-load, the output flow to the actuators having a high-load is decreased according to an increase in the loaded pressure of the high-load actuator, which causes the decreased output flow to the high-load actuator to supply to the low load actuator, thereby preventing a drop in an operating speed of the low-load actuator and ensures a smooth operation free of a shock without causing a sudden change in the speeds of actuators even if when the actuator having extremely different high-load is operated at the same time with the low-load actuator and the loaded pressure of the high-loaded actuator suddenly drops. Further, since the decreased output flow of the high-load actuator is supplied to the low-load actuator from beginning of the simultaneous operation of these actuators, the operating speed of the low-loaded actuator is secured from the beginning of the operation of the high-loaded actuator, further, the speed of the low-loaded actuator will not be accelerated and works smoothly during the simultaneous operation of these actuators even after the acceleration of the speed of the high-loaded actuator ceases and reaches to a constant speed operation.

Furthermore, since the output flow of the actuators having a high-load decreases according to an increase in the loaded pressure of the high-load actuator, this function attenuates an action of a constant power output regulation valve which decrease the delivery oil from the pump, and prevents a decrease of the delivery oil from the pump, thus decreases a loss delivery oil flowing out of an overload relief valve and decreases an energy loss.

These results are attained without providing an additional valve and a pilot line, resulting that the total valve bulk is made small, of low cost and very easy to handle.

BRIEF DESCRIPTION OF THE DRAWINGS

FIG. 1(*b*) is a partial hydraulic circuit diagram showing a pumping unit of an alternative embodiment of that of FIG. 1(*a*), wherein in stead of the pump flow control valve of FIG. 1(*a*), a pump delivery varying means is formed with a bleed-off valve 17' coupled with a constant power control means 19,6.

DETAILED DESCRIPTION OF THE PREFERRED EMBODIMENTS

Figure 1A:
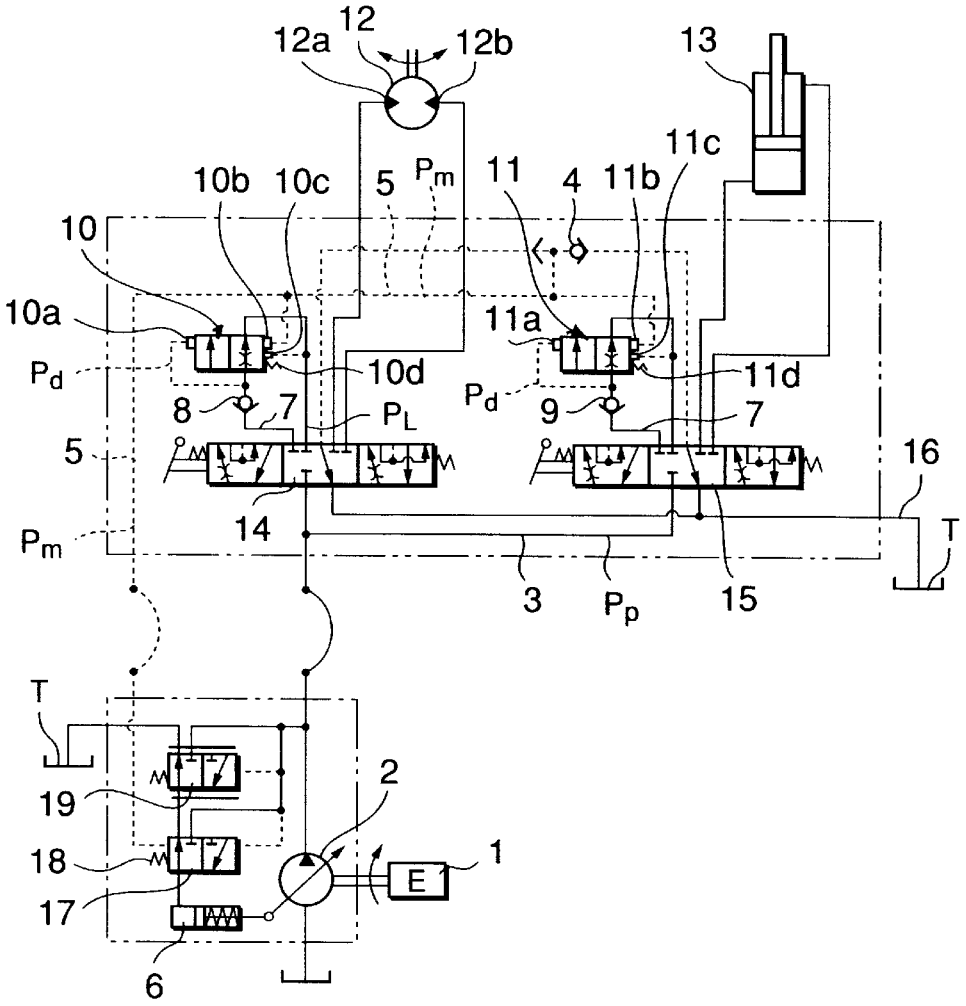
FIG. 1(*a*) is a hydraulic circuit diagram showing a hydraulic device which is a first embodiment of a first aspect of the present invention.
Figure 1B:
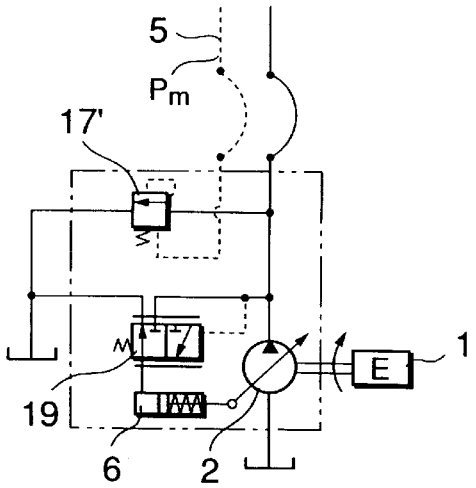

A hydraulic circuit diagram of a hydraulic device which is a first embodiment of a first aspect of the present invention will now be described with reference to FIG. 1. In FIG. 1, a pump delivery oil line 3 from a variable delivery pump (hereinafter referred to as "pump")2 of which only one is shown driven by an engine 1 flows into a plurality directional valves 14,15 of which only two are shown, and each has a flow control function for controlling the delivery oil flowing into a plurality of actuators 12,13 of which only two are shown, respectively, and after passing the throttles of the directional valves 14,15 the delivery oils flow via lines 7,7 and check valves 8,9 into the pressure compensation valves 10,11 of which only two are shown and then from there flow into actuators 12,13, respectively. The return pressure oils from each of the actuators 12,13 are exhausted via the directional valves 14,15 and tank lines 16 to a tank T. In FIG. 1, assuming that the actuator 13 being for a low-load (such as a boom cylinder which moves up-and-down a boom cylinder or a front bucket cylinder of a hydraulic excavator) and the actuator 12 being for a high inertial load (such as for a swing motor for a cab for the hydraulic excavator).

Each pressure compensation valve 10,11 located between the actuator 12,13 and the directional valve 14,15 both communicating with the pressure compensation valve has an anti-saturation function for controlling the directional valve 14,15 to distribute pump delivery to the individual actuators 12, 13 at an appropriate ratio when the pump delivery is smaller than a predetermined required flow of the plurality of driven actuators. To this end each pressure compensation valve 10,11 receives an oil pressure on a downstream side of a throttle of the directional valve coupled to the pressure compensation valve to act in a first control pressure chamber 10*a*,11*a* to open the pressure compensation valve and a maximum loaded pressure Pm of the loaded pressures of the hydraulic actuators 12,13 of the hydraulic device taken out by a shuttle valve 4 via lines 5 to act in a second control pressure chamber 10*b*,11*b* to close the pressure compensation valve, a spring 10*d*,11*d* is provided to act to close the pressure compensation valve, these features are similar to the conventional device shown in FIG. 5, and in this first embodiment the first aspect of the present invention, an oil pressure communicated with a loaded pressure PL of the actuator communicating with the pressure compensation valve to act in a third control pressure chamber 10*c*, 11*c* to close the pressure compensation valve, respectively. Each pressure receiving area of the first and second control pressure chambers 10*a*,11*a*,10*b*,11*b* is made nearly equal, while each pressure receiving area of the third control pressure chambers 10*c*,11*c* is made far smaller (a value obtained by dividing the pressure receiving area of the third control pressure chamber 10*c* by the pressure receiving area of the first control pressure chamber 10*a* ranges from 0 to 0.07) than that of the first control pressure chamber 10*a*,11*a*, thereby the pressure compensation valve decreasing output flow of the delivery oil to the respective actuator when the loaded pressure PL of the actuator communicating with the pressure compensation valve is increased.

Also, there is provided a variable displacement pump 2 for pumping the delivery oil to the actuators 12,13, a displacement varying means 6 coupled to the pump 2, a pump flow control valve 17 for communicating the delivery oil of the pump 2 with the displacement varying means 6 and a constant power output regulation valve 19. When the delivery oil pressure from the pump 2 exceed to a predetermined pressure set by a spring 18 of the pump flow control valve 17, the pump flow control valve 17 acts to the displacement varying means 6 to decrease the delivery oil of the pump 2 which performs a load-sensing required-stream regulation function. The constant power output regulation valve 19 acts to keep a torque of the engine 1 not to exceed over its rate torque, and takes precedence over the pump flow control valve 17 to decrease the delivery oil from the pump 2 through the auto-constant power output regulation function. That is, the auto-constant power output regulation function acts in precedence over the load-sensing function. Therefore, in case wherein a maximum pressure Pm of the actuators of the hydraulic device is relatively higher, the more the auto-constant power output regulation function acts, and the anti-saturation function is indispensable function for the construction machines.

In this first embodiment, a value obtained by dividing a pressure receiving area of a third control pressure chamber 10*c* by the pressure receiving area of the first control pressure chamber 10*a* of the pressure compensation valve 10 communicating with the actuator 12 having a high-load ranges from 0.03 to 0.07 which is made greater than that of the pressure compensation valve 11 communicating with the actuator 13 having a low-load which ranges from 0 to 0.02.

In this embodiment, the directional valves 14,15 may be of a pilot-operated type in which a pilot pressure supplied by a pilot pressure control valve rises in proportion to the amount of a control lever stroke as widely used in the construction machines, or they may be that of driven by a proportional solenoid, or a high-on-off switching solenoid controlled by a pulse width modulation. Further, only a pair of the actuators having high-loaded and low-loaded is shown herein, for convenience of explanation, however, in the practical hydraulic circuits of construction machines, it will be apparent that more than actuators in a similar circuit are widely used. Further, in this embodiment, only one set of the variable displacement pump 2, the displacement varying means 6 coupled to the pump 2, the pump flow control valve 17 and the constant power output regulation valve 19 are shown, however, a plurality set of variable displacement pumps and associated valves may be used. Further, as shown in FIG. 1(*b*), in place of the displacement varying means 6 coupled to the pump 2 and the pump flow control valve 17, a delivery oil varying means may be constant power control means 19,6 and a bleed off valve 17' communicating with the tank and located in parallel with the pump line. The bleed off valve 17' may be located in a valve unit instead of locating in the pump unit as shown in FIG. 1(*b*).

The operation of the embodiment shown in FIG. 1 will now be described. Firstly, the balance of the forces applied to each of the pressure compensation valves 10,11 will be discussed. When an oil pressure on a downstream side of a throttle of the directional valve coupled to the pressure compensation valve is denoted as Pd, and an area of each first control pressure chamber 10*a*,11*a* is denoted as Aa, the force F1 which acts to open the pressure compensation valve rightward may be expressed as:

$$F1=(Pd\cdot Aa) \tag{1}$$

Conversely, when a maximum loaded pressure is denoted as Pm, a loaded pressure of the actuator on a downstream side of the pressure compensation valve is denoted as PL, an area of each second control pressure chamber 10*b*,11*b* is denoted as Ab, and an area of each third control pressure chamber 10*c*,11*c* is denoted as Ac, the force F2 which acts to close the pressure compensation valve leftward may be expressed as:

$$F2=(Pm\cdot Ab+PL\cdot Ac) \tag{2}$$

The forces acting in the two opposite directions are balanced during operation of the pressure compensation valve and the results of the expression (1) and the expression (2) are equal, F1=F2; therefore, the following expression may be derived:

$$(Pd \cdot Aa) = (Pm \cdot Ab + PL \cdot Ac) \quad (3)$$

where the acting force of each of the springs 10*d*,11*d* is ignored since it is extremely weak.

If it is assumed that a pre-set differential pressure between the pump delivery pressure Pp and the maximum loaded pressure Pm is denoted as Psp which is set by the spring 18 of the pump flow control valve 17, and an oil pressure on an upstream side of a throttle part of the directional valve which is the pump delivery pressure Pp on a line 3 may be expressed as:

$$Pp = Pm + Psp \quad (4)$$

From the expression (4), the following expression may be derived:

$$Pm = Pp - Psp \quad (5)$$

Substituting Pm=Pp−Psp into the expression (3), the following expression may be derived:

$$(Pd \cdot Aa) = (Pp - Psp) \cdot Ab + PL \cdot Ac \quad (6)$$

Assuming that the area of each first and second control pressure chamber 10*a*, 11*a*, 10*b*, 11*b* is equal, that is:

$$A = Aa = Ab \quad (7)$$

The expression (6) may be derived:

$$Pd = Pp - Psp + PL \cdot Ac / A \quad (8)$$

From expression (8), the directional valve differential pressure ΔP=Pp−Pd may be derived:

$$\Delta P = Pp - Pd \quad (9)$$
$$= Psp - PL \cdot Ac / A$$

Or, by substituting Psp=Pp−Pm of expression (5) into expression (9) the following expression may be derived:

$$\Delta P = Pp - Pm - PL \cdot Ac / A \quad (10)$$

According to the expression (9), the directional valve differential pressure ΔP which is a differential pressure across the throttle of the directional valve, is expressed as a value obtained by solving a linear function (9) which is a function of the pre-set differential pressure Psp set by the spring 18 of pump flow control valve 17, and the loaded pressure PL of the actuator on the downstream side of the pressure compensation valve, further, the respective directional valve differential pressures ΔP decrease and the output flow to the actuator decreases as the actuator loaded pressures PL increase. In other words, a right-down gradient characteristic of the pressure compensation value is obtained wherein the output flow to the actuator decreases as the actuator loaded pressure PL increases. Further, according to the expression (10), the directional valve differential pressure ΔP is expressed as a value obtained by solving a linear function (10) which is a function of the differential pressure between the pump delivery pressure Pp and the maximum loaded pressure Pm, and the loaded pressure PL of the actuator on the downstream side of the directional valve, further, the respective directional valve differential pressures ΔP decrease and the output flow to the actuator decreases as the actuator loaded pressures PL increase. In other words, a right-down gradient characteristic of the pressure compensation value is obtained wherein the output flow to the actuator decreases as the actuator loaded pressure PL increases.

In the embodiment, since a value dividing the pressure receiving area Ac of each third control pressure chamber 10*c*,11*c* by the pressure receiving area Aa of each first control pressure chamber 10*a*,11*a* ranges from 0.03 to 0.07, the value of Ac/A of the second member of the expression (9) and the third member of the expression (10) become very small. Therefore, on condition that the loaded pressure PL of the actuator on a downstream side of the pressure compensation valve is relatively low, a value of Ac/A of a second member of the expression (9) and a third member of the expression (10) may be ignored, therefore, from the expression (9), the following expression may be derived:

$$\Delta P = Psp \quad (11)$$

Or, from the expression (10), similarly;

$$\Delta P = Pp - Pm \quad (12)$$

Figure 5:
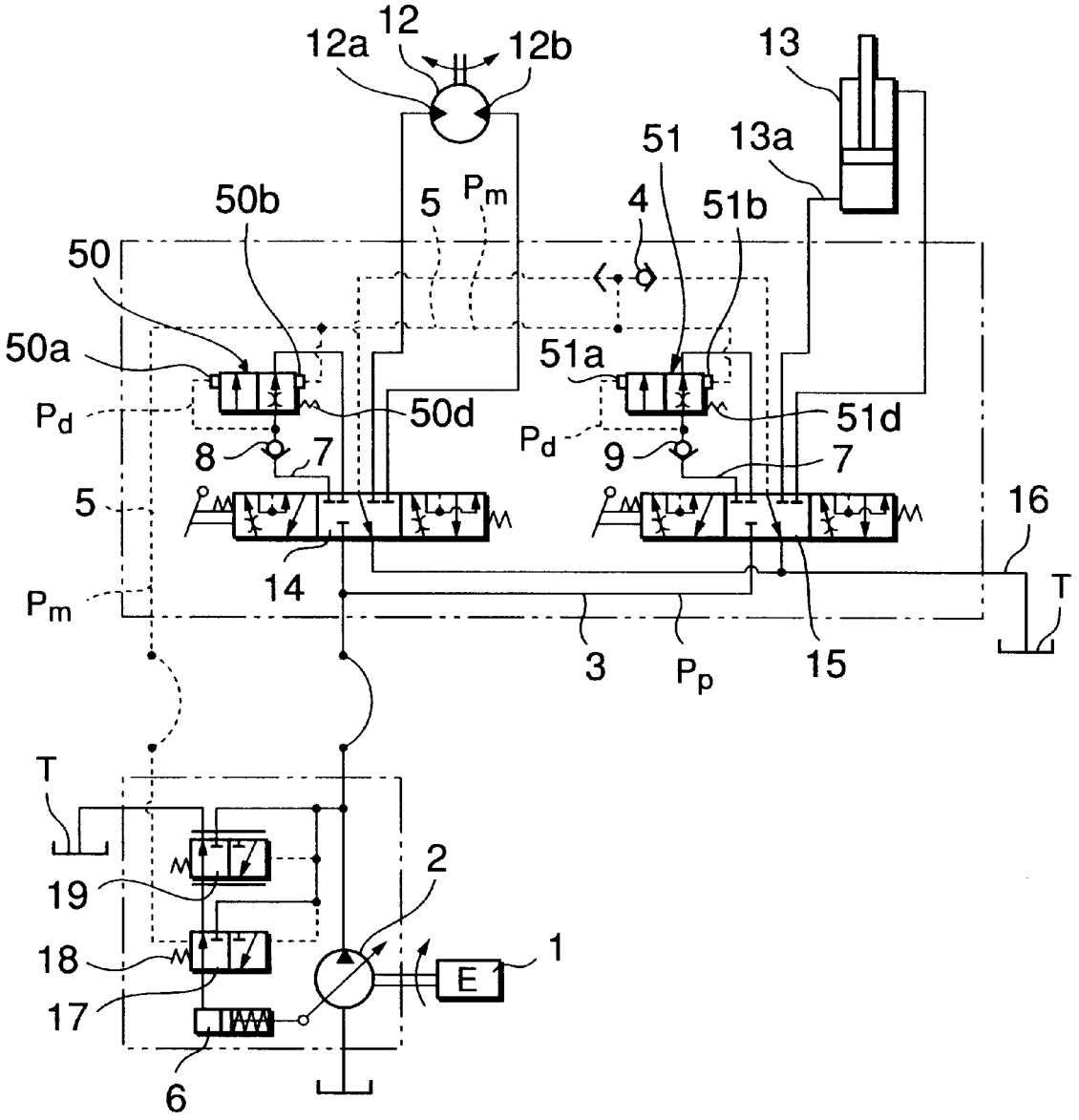
Fig.5 (PRIOR ART)
FIG. 5 is a PRIOR ART hydraulic circuit diagram showing a first conventional hydraulic device.

That is, on condition that a loaded pressure PI, of an actuator on a downstream side of the pressure compensation valve is relatively low, the respective directional valve differential pressures ΔP come into agreement with the pre-set differential pressure Psp set by the spring 18, namely the differential pressures between the pump delivery pressure Pp and the maximum loaded pressure Pm, as been seen in the conventional device shown in FIG. 5. Therefore, even if the load pressure of each actuator may differ from each other, the respective speeds of the actuators may be controlled at a predetermined rates, and perform an anti-saturation function.

In addition to this, in the first embodiment of the first aspect of the present invention, as previously discussed, the value obtained by dividing the pressure receiving area of the third control pressure chamber 10*c* by the first control pressure chamber 10*a* of the pressure receiving area of the pressure compensation valve 10 communicating with the high-load actuator 12 ranges from 0.03 to 0.07, and that of the pressure compensation valve 11 communicating with the low-load actuator 13 ranges from 0 to 0.02, the value of Ac/A for the high-load actuator 12 is made greater than that of the low-load actuator 13.

To make an explanation easy, in FIG. 1, assuming that the value of Ac/A for the high-load actuator 12 for the swing motor ranges from 0.03 to 0.07, and the value of Ac/A of the low-load actuator 13 for the boom cylinder is 0, that is Ac/A=0. In this case, the above expressions (9) and (10) may be applied to the actuator 12 for the swing motor, whereas the above expressions (11) and (12) may be applied to the actuator 13 for the boom cylinder. On condition that the actuator 13 for the boom cylinder and the actuator 12 for a swing motor are compoundly and simultaneously operated, and assuming that the pump delivery oil is sufficiently supplied and is not reached to a saturation condition, the differential pressure ΔP of the directional valve 15 communicating with the low-load actuator 13 will be a constant value as been led by the above expressions (11) and (12). While the differential pressure ΔP of the directional valve 14 communicating with the high-load actuator 12 will decrease in accordance to the rise of the load of the swing motor as been led by the above expressions (9) and (10), resulting the decrease of the amount of the pump delivery oil flowing into the actuator 12.

On the other hand, since the inertial load of the swing motor is excessively high in such a compound operation, as previously discussed, the constant power output regulation valve 19 takes precedence over the pump flow control valve 17 to decrease the delivery oil from the pump 2, and the system reaches to a saturated condition. In this situation, the pump delivery pressure Pp will not be able to keep as high as by the difference pressure derived by deducting the pre-set differential pressure being set by the spring 18 from the maximum loaded pressure Pm. Assuming that the pump delivery pressure in this situation as denoted Pp', and Pp'−Pm=Psp', the amount of the value of the Psp' fluctuates depending on the degree of the amount of the shortage of the pump delivery oil requiured, and does not reach to a constant value. An even pump delivery pressure Pp' acts on each upstream side of the directional valves, and the respective directional valve differential pressures ΔP' will be derived followingly:

Assuming that the directional valve differential pressures ΔP' for actuator 13 for the boom cylinder is denoted as ΔPb';

$$\Delta Pb' = Psp' = Pp' - Pm \tag{13}$$

And assuming that the directional valve differential pressures ΔP' for the actuator 12 for the swing motor is denoted as ΔPs';

$$\begin{aligned}\Delta Ps' &= Psp' - PLs \cdot Ac / A \\ &= Pp' - Pm - PLs \cdot Ac / A\end{aligned} \tag{14}$$

wherein, PLs denotes the own load pressure of the actuator 12 for the swing motor.

From the expression (14), the directional valve differential pressures ΔPs' for the actuator 12 for the swing motor depends on the maximum loaded pressure Pm, the pump delivery pressure Pp', and the own load pressure PLs of the actuator 12 for the swing motor, while the pump delivery pressure Pp' is a pressure higher by the amount of Psp' than the maximum loaded pressure Pm, thus the directional valve differential pressures ΔPs' decreases in accordance with the rise in the own load pressure PLs still after entering into the saturated condition. On the other hand, from the expression (13), the directional valve differential pressures ΔPb' for the actuator 13 for the boom cylinder does not depends on the own load pressure PLs of the actuator 13, rather depends on the maximum loaded pressure Pm and the pump delivery pressure Pp' which is higher by the amount of Psp' than the maximum loaded pressure Pm.

This means that in the early stage of the compound and simultaneous operations of the actuator 13 for the boom cylinder and the actuator 12 for a swing motor, the pump delivery pressure Pp' substantially rise depending on the abrupt rise of the own load pressure PLs of the actuator 13, and decreases the pump delivery oil flow, and even if it reached to a saturation condition, since the pump delivery oil to be supplied to the actuator 12 for a swing motor decreases, as a total, there arises a surplus in the pump delivery oil flows, that is the pump delivery oil flow will be kept in a relatively high level. Then, from the expression (13), the directional valve differential pressures ΔPb' for the actuator 13 for the boom cylinder rises and the pump delivery oil to be supplied to the actuator 13 for the boom cylinder increases. In other words, the pump delivery oil to be supplied to the actuator 13 for the boom cylinder increases by the amount of the decrease of that of to the actuator 12 for a swing motor.

Further, since the amount of the pump delivery oil to be supplied to the actuator 12 for a swing motor decreases, a relieved delivery loss oil flowing into the tank out of the overload relief valves for the actuator 12 decreases, at the same time prevents an abrupt rise of a loaded pressure of the actuator 12 for a swing motor. Thus, a rise of the pump pressure is made low, alleviates the auto-constant power output regulation by the constant power output regulation valve 19 and the pump delivery oil increases. Then, the speed of the actuator 13 for the boom cylinder increases. In this way, in the early stage of the compound and simultaneous operations of the actuators, the device shown in FIG. 1 prevents both a lowering of the extension speed of the actuator for the boom cylinder and an energy loss of the engine.

In addition, in this early stage of the swinging movement of the swing motor, arising out of an excessive high inertia of the swing motor, the loaded pressure PLs of the actuator 12 for the swing motor rises, as derived from the expression (14), the directional valve differential pressures ΔPs' for the actuator 12 for the swing motor is made to decrease, and the delivery oil flowing into the directional valve 14 is made to decrease. From this situation, in correspond to the increase in the speed of the actuator 12 for the swing motor and the decreases in the acceleration thereof, the directional valve differential pressures ΔPs' gradually increases and the delivery oil flowing into the directional valve 14 gradually increases. In other words, the delivery oil flowing into the directional valve 14 gradually increases according to the loaded pressure PLs of the actuator 12 for the swing motor decreases, thereby a moderate acceleration of the swing motor is obtained.

Secondly, when actuator 12 for the swing motor loses the acceleration and reaches to a constant speed swinging movement, a loaded pressure PLs suddenly decreases, then the loaded pressure of the actuator 13 for boom cylinder becomes higher than that of the actuator 12. As discussed, in the above conventional hydraulic devices, the pump delivery oil suddenly increases through the easing of the operation of the constant power output regulation valve resulting an abrupt acceleration of the speed of the boom cylinder 13. However, in this first embodiment, since the amount of the decreased output flow to the high-load actuator 12 is supplied to the low-load actuator 13, from the early stage of the compound and simultaneous operations of the actuators, the operating speed of the actuator for the boom cylinder is not accelerated with a shock. And the actuator 13 operate shocklessly as a continuous movement in correspond to the decrease in the speed of the actuator 12 for the swing motor, and not as a discontinuous ones.

Figure 2:
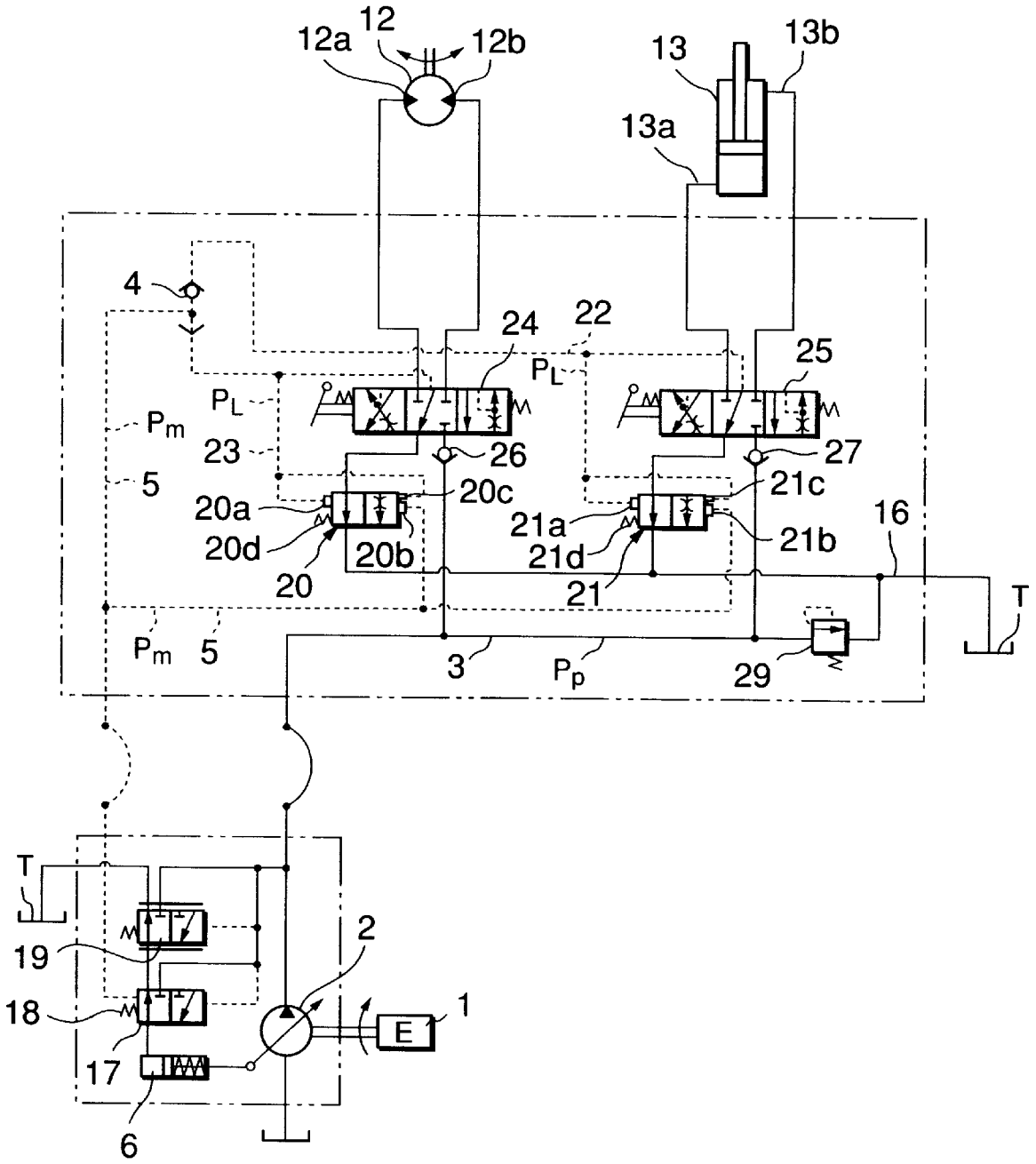
FIG. 2 is a hydraulic circuit diagram showing a hydraulic device which is a second embodiment of the first aspect of the present invention.
Figure 6:
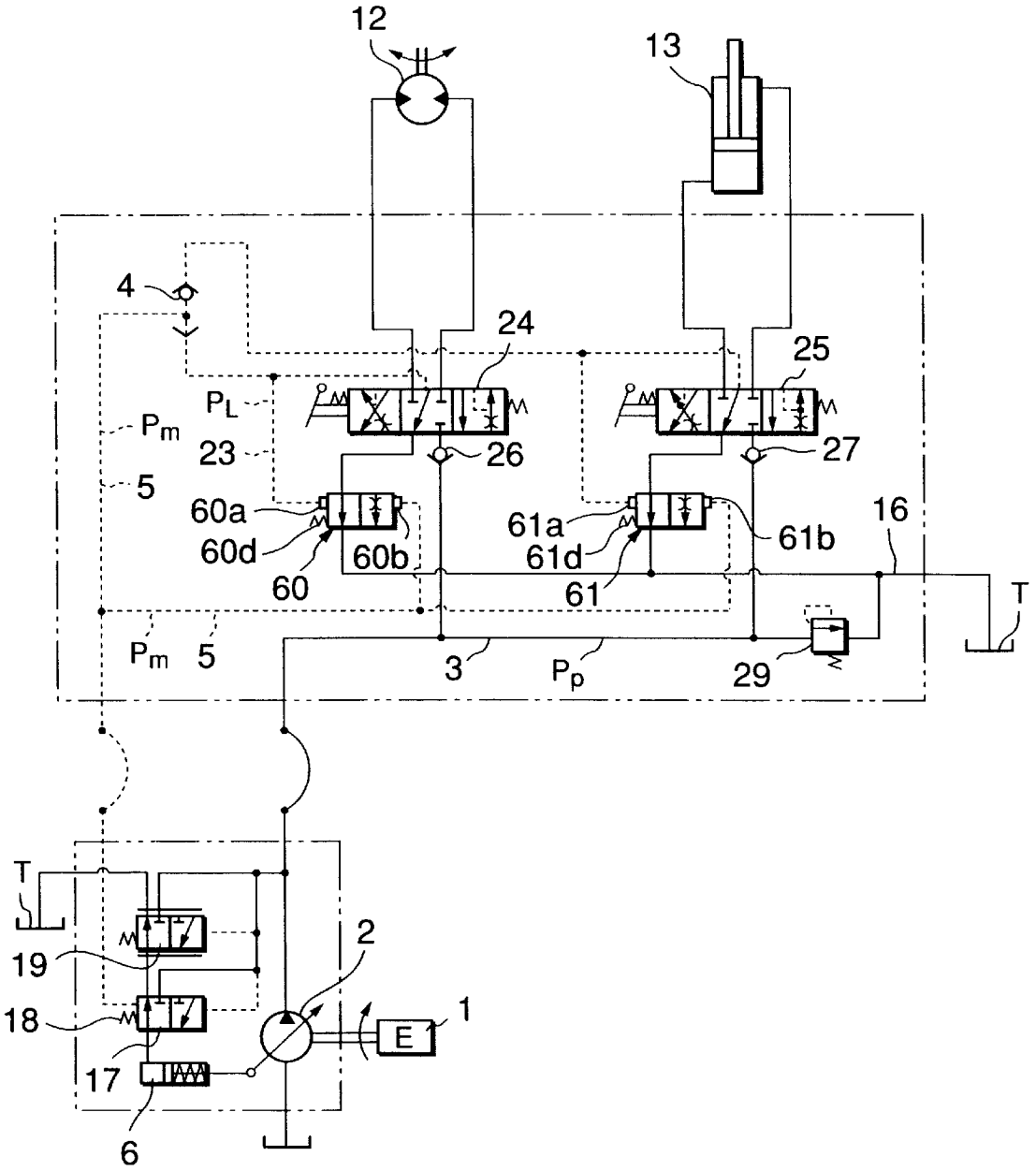
Fig.6 (PRIOR ART)
FIG. 6 is a PRIOR ART hydraulic circuit diagram showing a second conventional hydraulic device.

FIG. 2 shows a hydraulic circuit diagram of a hydraulic device which is a second embodiment of the first aspect of the present invention, and which is an improved hydraulic circuit diagram over the second conventional hydraulic circuit diagram shown in FIG. 6. Like parts as those of the embodiment shown in FIG. 1 will be assigned like reference numerals and the description thereof will be partially omitted. The hydraulic circuit for the hydraulic device of FIG. 2 has both the anti-saturation function and the load-sensing function as shown in FIG. 1. Branching from a pump line 3 and via check valves 26, 27, a plurality of directional valves 24,25 of which only two are shown, are disposed in paralell each having flow control function capable of controlling the pump delivery oil from a variable displacement pump 2 flowing into a plurality of actuators 12,13 of which only two are shown, respectively. The delivery oils flowing out of the throttle of the directional valves 24, 25 are led into the actuators 12, 13. Each return oils flowing out of the actuators 12, 13 are again led into the directional valves 24,25, and then via a plurality of pressure compensation valves 20,21 of which only two are shown are exhausted to a tank T via tank lines 16. The pressure compensation valves 20,21 coupled to and for compensating pressures of the directional valves 24,25 are located on each downstream side of the directional valves 24,25 before a tank line 16, respectively. Each pressure compensation valve 20,21 receives an oil pressure on a downstream side of a throttle of the directional valve 24,25, which oil pressure is communicated with a loaded pressure PL of the actuator communicating with the pressure compensation valve, to act in a first control pressure chamber 20*a*,21*a* to open the pressure compensation valve, a maximum loaded pressure of the loaded pressures of the hydraulic actuators of the hydraulic device to act in a second control pressure chamber 20*b*,21*b* to close the pressure compensation valve, and an oil pressure on a downstream side of the throttle of the directional valves 24,25, which oil pressure is communicated with a loaded pressure PL of the actuator, to act in a third control pressure chamber 20*c*,21*c* to close the pressure compensation valve, respectively. Each pressure receiving area of the first and second control pressure chambers 20*a*, 21*a*, 20*b*, 21*b* is made nearly equal, while each pressure receiving area of the third control pressure chambers 20*c*,21*c* is made far smaller (a value obtained by dividing a pressure receiving area of a third control pressure chamber 20*c* by a pressure receiving area of a first control pressure chamber 20*a* ranges from 0 to 0.07).

Also in this second embodiment, a value obtained by dividing the pressure receiving area of the third control pressure chamber 20*c* by the pressure receiving area of the first control pressure chamber 20*a* of the pressure compensation valve 20 communicating with the actuator 12 having the high-load ranging from 0.03 to 0.07 is made greater than that of the pressure compensation valve 21 communicating with the actuator 13 having the low-load ranging from 0 to 0.02.

By such an arrangement, this second embodiment of the hydraulic device shown in FIG. 2 performs similar operations as described in the first embodiment shown in FIG. 1.

The operation of the embodiment shown in FIG. 2 will now be described. Firstly, the balance of the forces applied to each pressure compensation valve 20,21 will be discussed. When an oil pressure on a downstream side of a throttle of the directional valve coupled to the pressure compensation valve communicated with a loaded pressure of the actuator is denoted as PL, and an area of each first control pressure chamber 20*a*,21*a* is denoted as Aa, the force F1 which acts to open the pressure compensation valve rightward may be expressed as:

$$F1 = (PL \cdot Aa) \tag{21}$$

Conversely, when a maximum loaded pressure of the loaded pressures of the hydraulic actuators of the hydraulic device is denoted as Pm, an area of each second control pressure chamber 20*b*,21*b* is denoted as Ab, and an area of each third control pressure chamber 20*c*,21*c* is denoted as Ac, the force F2 which acts to close the pressure compensation valve leftward may be expressed as:

$$F2 = (Pm \cdot Ab + PL \cdot Ac) \tag{22}$$

The forces acting in the two opposite directions are balanced during the operation of the pressure compensation valve and the results of the expression (21) and the expression (22) are equal, F1=F2; therefore, the following expression may be derived:

$$(PL \cdot Aa) = (Pm \cdot Ab + PL \cdot Ac) \tag{23}$$

where the acting force of each spring 20*d*,21*d* is ignored since it is extremely weak.

If it is assumed that a pre-set differential pressure between the pump delivery pressure Pp and the maximum loaded pressure Pm is denoted as Psp which is set by the spring 18 of the pump flow control valve 17, and an oil pressure on an upstream side of a throttle part of the directional valve which is the pump delivery pressure Pp on a line 3 may be expressed as:

$$Pp = Pm + Psp \tag{24}$$

From the expression (24), the following expression may be derived:

$$Pm = Pp - Psp \tag{25}$$

Substituting Pm=Pp−Psp into the expression (23), the following expression may be derived:

$$(PL \cdot Aa) = (Pp - Psp) \cdot Ab + PL \cdot Ac \tag{26}$$

Assuming that the area of each first and second control pressure chamber 20*a*, 21*a*, 20*b*, 21*b* is equal, that is:

$$A = Aa = Ab \tag{27}$$

The expression (26) may be derived:

$$PL = Pp - Psp + PL \cdot Ac / A \tag{28}$$

From expression (28), the directional valve differential pressure ΔP=Pp−PL may be derived:

$$\begin{aligned} \Delta P &= Pp - PL \\ &= Psp - PL \cdot Ac / A \end{aligned} \tag{29}$$

Or, by substituting Psp=Pp−Pm of expression (25) into expression (29) the following expression may be derived:

$$\Delta P = Pp - Pm - PL \cdot Ac / A \tag{210}$$

According to the expression (29), the directional valve differential pressure ΔP which is a differential pressure across the throttle of the directional valve, is expressed as a value obtained by solving a linear function (29) which is a function of the pre-set differential pressure Psp set by the spring 18 of pump flow control valve 17, and the loaded pressure PL of the actuator on the downstream side of the directional valve, further, the respective directional valve differential pressures ΔP decrease and the output flow to the actuator decreases as the actuator loaded pressures PL increase. In other words, a right-down gradient characteristic of the pressure compensation value is obtained wherein the output flow to the actuator decreases as the actuator loaded pressure PL increases. Further, according to the expression (210), the directional valve differential pressure ΔP is expressed as a value obtained by solving a linear function (210) which is a function of the differential pressure between the pump delivery pressure Pp and the maximum loaded pressure Pm, and the loaded pressure PL of the actuator on the downstream side of the directional valve, further, the respective directional valve differential pressures ΔP decrease and the output flow to the actuator decreases as the actuator loaded pressures PL increase. In other words, a right-down gradient characteristic of the pressure compensation value is obtained wherein the output flow to the actuator decreases as the actuator loaded pressure PL increases.

Therefore, the above discussions with reference to the first embodiment shown in FIG. 1 all apply to this second embodiment of the first aspect of this invention of the hydraulic device shown in FIG. 2 performing similar effects.

Figure 3:
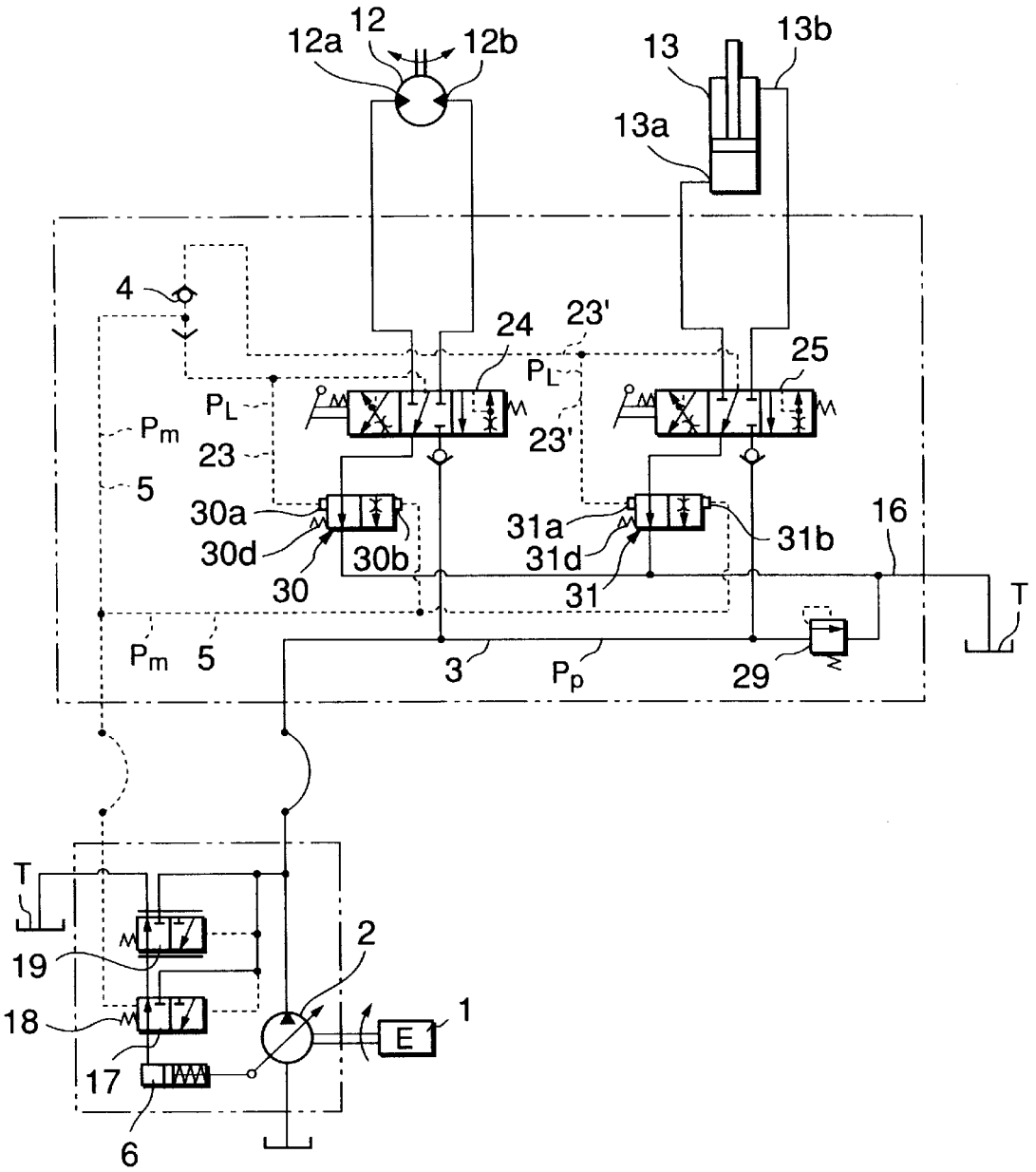
FIG. 3 is a hydraulic circuit diagram showing a hydraulic device which is an embodiment of a second aspect of the present invention.

FIG. 3 shows a hydraulic circuit diagram of a hydraulic device which is an embodiment of a second aspect of the present invention, and which is an improved hydraulic circuit comprising improved pressure compensation values 30, 31 over the second embodiment of the first aspect of the present invention shown in FIG. 2. Like parts as those of the embodiment shown in FIGS. 1 and 2 will be assigned like reference numerals and the description thereof will be partially omitted. The hydraulic circuit for a hydraulic device of FIG. 3 has both the anti-saturation function and the load-sensing function as shown in FIGS. 1 and 2.

In FIG. 3, a plurality of improved pressure compensation valves 30,31 of which only two are shown which are coupled to and for compensating pressures of a plurality of the first and second directional valves 24, 25 of which only two are shown and located between the directional valve and a tank line 16, respectively. Each pressure compensation valve 30,31 receives an oil pressure on a downstream side of a throttle of the directional valve 24,25, which pressure is communicated with a loaded pressure PL of the actuator, to act in a first control pressure chamber 30*a*,31*a* to open the pressure compensation valve, and a maximum loaded pressure Pm taken out by a shuttle valve 4 of the loaded pressures of the hydraulic actuators of the hydraulic device to act in a second control pressure chamber 30*b*, 31*b* to close the pressure compensation valve. A value obtained by dividing the pressure receiving area Ba of the first control pressure chamber 30*a* by the pressure receiving area Ab of the second control pressure chamber 30*b* of the pressure compensation valve 30 communicating with the hydraulic actuator 12 having the high-load, ranges from 0.93 to 0.97, while a value obtained by dividing the pressure receiving area Ca of the first control pressure chamber 31*a* by the pressure receiving area Ab of the second control pressure chamber 31*b* of the pressure compensation valve 31 communicating with the hydraulic actuator 13 having the low-load, ranges from 0.98 to 1.00. Thereby, the rate of the decreasing the output flow of the delivery oil to actuator 12 having the high-load when the loaded pressure of the pressure compensation valve 30 communicating with the high-load actuator 12 is increased is made greater than that of the pressure compensation valve 31 communicating with the actuator 13 having the low-load. In short, in FIG. 3, each pressure receiving area Ba or Ca of the first control pressure chamber 30*a*,31*a* is made smaller than that Ab of the second control pressure chamber 30*b*,31*b* by the pressure receiving area Ac of the third control pressure chambers 20*c*,21*c* shown in FIG. 2.

By such an arrangement, this embodiment of the second aspect of the present invention shown in FIG. 3 performs similar operations as described in the second embodiment shown in FIG. 2.

The operation of the embodiment shown in FIG. 3 will now be described. Firstly, the balance of the forces applied to the pressure compensation valve 30 will be discussed. When an oil pressure on a downstream side of a throttle of the directional valve 24 coupled to the pressure compensation valve 30 communicated with a loaded pressure of the actuator 12 is denoted as PL, and the pressure receiving area of the first control pressure chamber 30*a* is denoted as Ba, the force Fl which acts to open the pressure compensation valve 30 rightward may be expressed as:

$$F1 = (PL \cdot Ba) \tag{31}$$

Conversely, when the maximum loaded pressure is denoted as Pm, and the pressure receiving area of the second control pressure chamber 30*b* is denoted as Ab, the force F2 which acts to close the pressure compensation valve 30 leftward may be expressed as:

$$F2 = (Pm \cdot Ab) \tag{32}$$

The forces acting in the two opposite directions are balanced during the control by the pressure compensation valve and the results of the expression (31) and the expression (32) are equal, F1=F2; therefore, the following expression may be derived:

$$(PL \cdot Ba) = (Pm \cdot Ab) \tag{33}$$

where the acting force of the springs 30*d* is ignored since it is extremely weak.

If it is assumed that a pre-set differential pressure between the pump delivery pressure Pp and the maximum loaded pressure Pm is denoted as Psp which is set by the spring 18 of the pump flow control valve 17, and an oil pressure on an upstream side of a throttle part of the pressure compensation valve which is the pump delivery pressure Pp on a line 3 may be expressed as:

$$Pp = Pm + Psp \tag{34}$$

From the expression (34), the following expression may be derived:

$$Pm = Pp - Psp \tag{35}$$

Substituting Pm=Pp−Psp of the expression (35) into the expression (33), the following expression may be derived:

$$(PL \cdot Ba) = (Pp - Psp) \cdot Ab \tag{36}$$

Assuming that the pressure receiving area Ba < the pressure receiving area Ab, and Ba/Ab=k wherein k<1, and $$k \cdot PL = Pp - Psp \tag{37}$$

For the purpose of convenience, if k=[1−(1−k)] in the expression (37) may be modified as follows:

$$PL \cdot [1-(1-k)]Pp - Psp$$

$$PL - PL \cdot (1-k)Pp - Psp \tag{38}$$

From expression (38), the directional valve differential pressure ΔP=Pp−PL may be derived:

$$\Delta P = Pp - PL \tag{39}$$

$$= Psp - PL \cdot (1 - k)$$

Or, by substituting Psp=Pp−Pm of expression (35) into expression (39) the following expression may be derived:

$$\Delta P = Pp - Pm - PL \cdot (1 - k) \tag{310}$$

Since k<1, according to the expression (39), the directional valve differential pressure ΔP which is a differential pressure across the throttle of the directional valve, is expressed as a value obtained by solving a linear function (39), that is the directional valve differential pressure ΔP is a function of the pre-set differential pressure Psp set by the spring 18 of pump flow control valve 17, and the loaded pressure PL of the actuator on the downstream side of the directional valve, further, the respective directional valve differential pressures ΔP decrease and the output flow to the actuator decreases as the actuator loaded pressures PL increase. In other words, a right-down gradient characteristic of the pressure compensation valve is obtained wherein the output flow to the actuator decreases as the actuator loaded pressure PL increases.

Further, according to the expression (310), the directional valve differential pressure ΔP is expressed as a value obtained by solving a linear function (310) which is a function of the differential pressure between the pump delivery pressure Pp and the maximum loaded pressure Pm, and the loaded pressure PL of the actuator on the downstream side of the directional valve, further, the respective directional valve differential pressures ΔP decrease and the output flow to the actuator decreases as the actuator loaded pressures PL increase. In other words, a right-down gradient characteristic of the pressure compensation valve is obtained wherein the output flow to the actuator decreases as the actuator loaded pressure PL increases.

Therefore, the above discussions with reference to the first embodiment of the first aspect of the present invention shown in FIG. 1 all apply to the embodiment shown in FIG. 3 performing similar effects.

Figure 4:
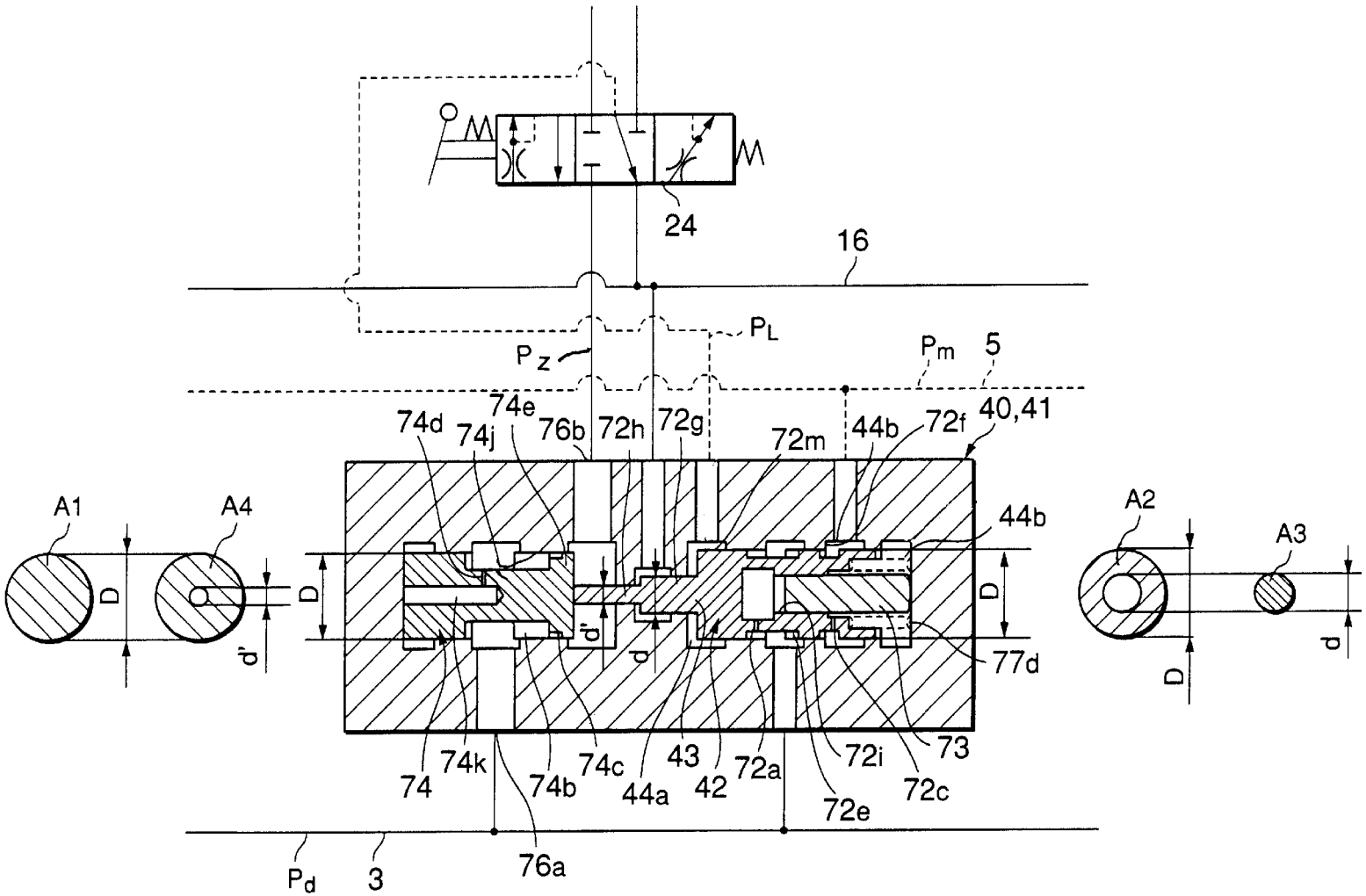
FIG. 4 is a conceptual structure diagram showing a section of an improved pressure compensation valve which is an embodiment of the hydraulic device of a third embodiment of the first aspect of the present invention adapted for employment for the hydraulic circuit shown in FIG. 7(PRIOR ART).
Figure 7:
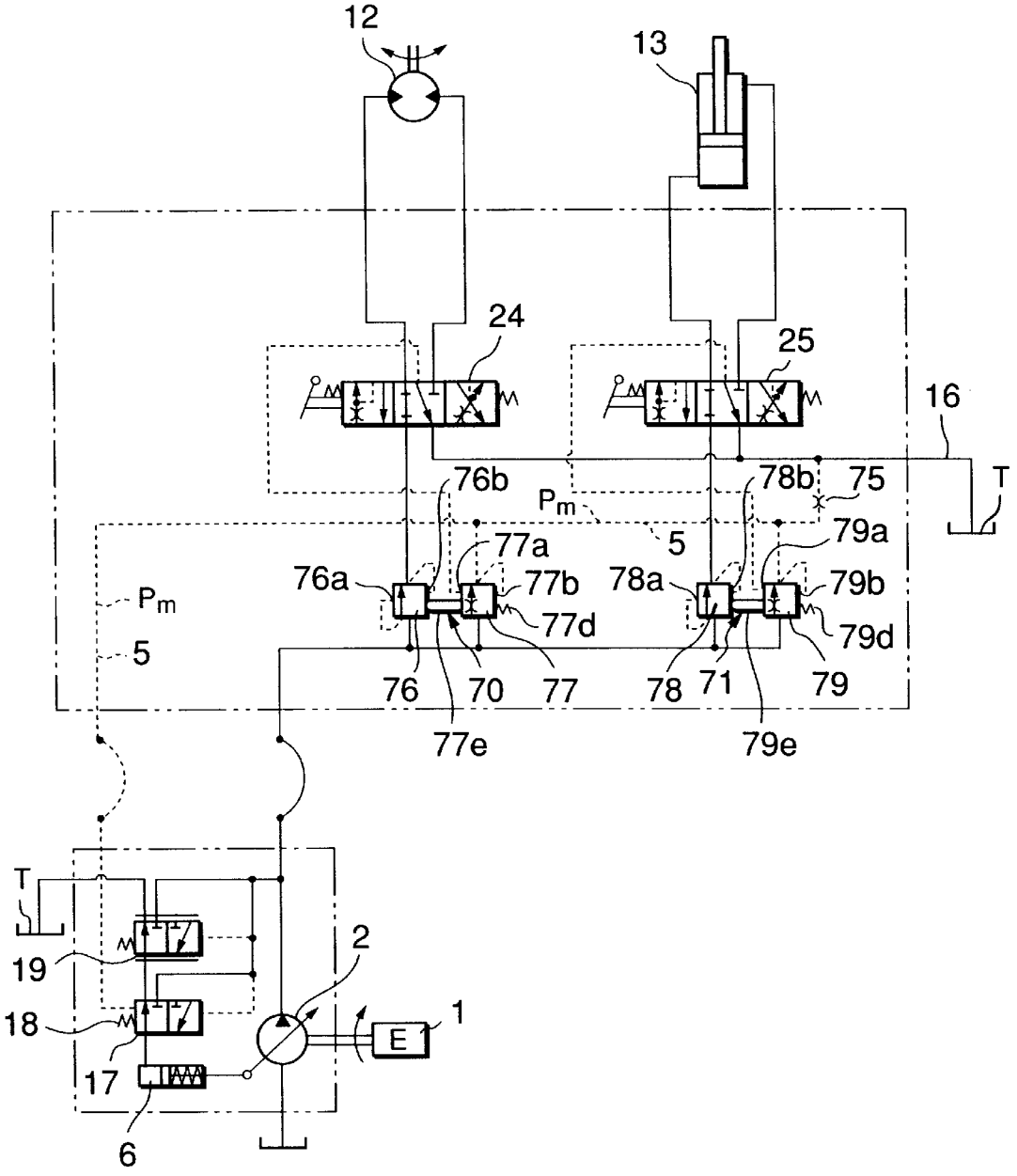
Fig.7 (PRIOR ART)
FIG. 7 is a PRIOR ART hydraulic circuit diagram showing a third conventional hydraulic device.
Figure 8:
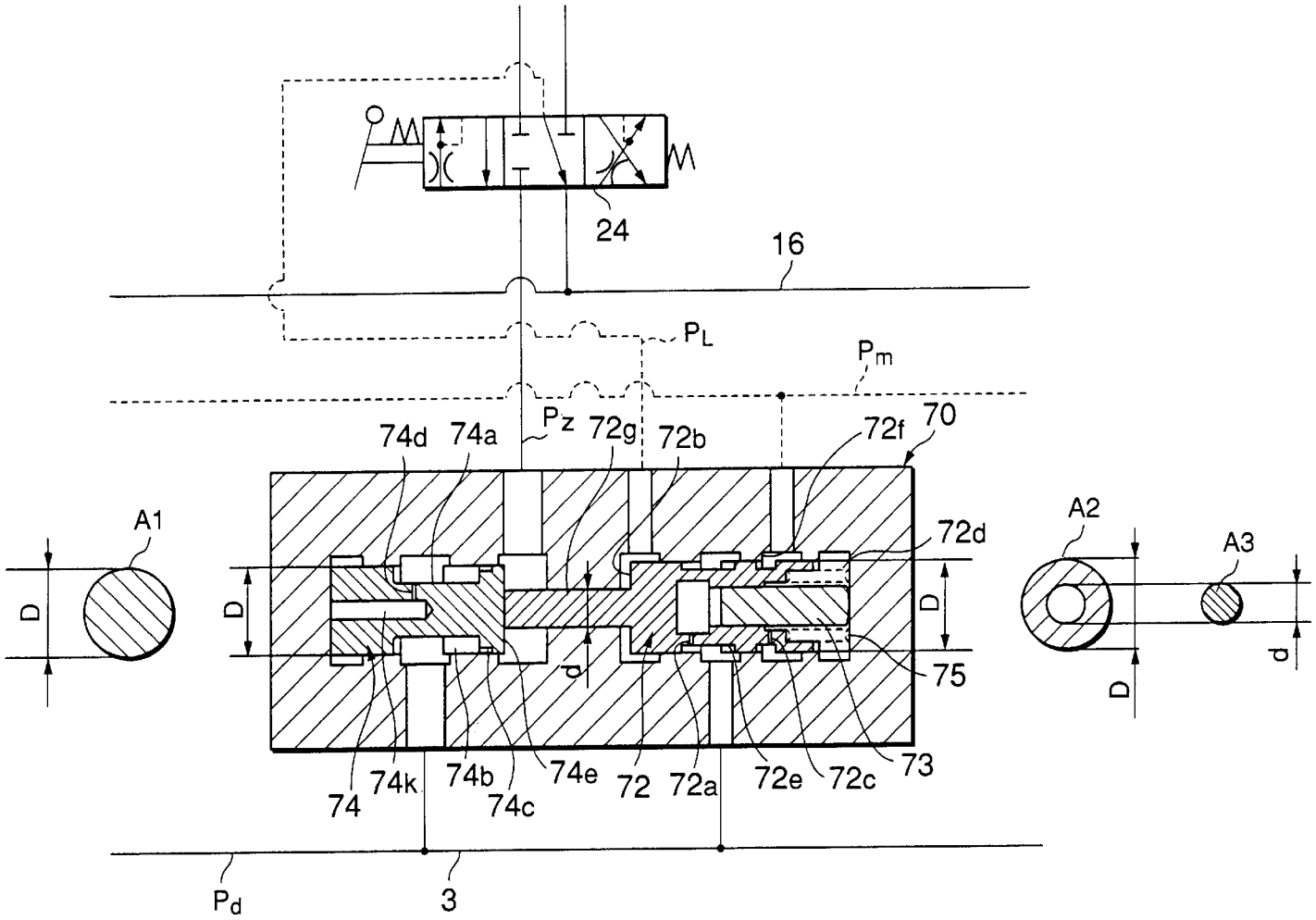
Fig.8 (PRIOR ART)
FIG. 8 is a PRIOR ART conceptual structure diagram showing a section of a conventional pressure compensation valve adapted for employment for the hydraulic device shown in FIG. 7.

FIG. 4 shows a schematically cross sectional block view of an improved pressure compensation valve 40,41 which is adapted to use in place of the conventional pressure compensation valve 70,71 shown in FIGS. 7 and 8 which is disclosed in U.S. Pat. No. 5,622,206, and Japanese Publication No. 05332310; 05332311. Like parts as those of the embodiment shown in FIGS. 1 to 3 will be assigned like reference numerals and the description thereof will be partially omitted. The hydraulic circuit for the hydraulic device of FIG. 7 using the improved pressure compensation valve 40,41 of FIG. 4 has both the anti-saturation function and the load-sensing function as shown in FIG. 1. Branching from a pump line 3 in paralell a plurality of pressure compensation valves 40,41 is located between pump lines 3 from the pump 2 and directional valves 24,25 communicating with the pressure compensation valve 40,41, respectively. Each pressure compensation valve 40,41 (hereinafter generally shown as the pressure compensation valves 40 shown in FIG. 4)is integrally formed with a check valve portion 74 which normally blocks the reverse flow from the actuator to the pump lines 3 and throttles the pump delivery oil flowing into the actuator, and a reducing valve portion 42 having a reducing valve spool 43 contactable with to close the check valve spool 74*e* of the check valve portion 74 and capable of reducing the pressure of the pump delivery oil from the pump line 3 down to a maximum loaded pressure Pm of the loaded pressures of the hydraulic actuators of the hydraulic device. And the pressure compensation valves 40 receives the loaded pressure PL of the hydraulic actuator coupled to the pressure compensation valve 40, which pressure is an oil pressure on a downstream side of a throttle of the directional valve 24, to act in a first control pressure chamber 44*a* of the pressure compensation valve 40 to open the pressure compensation valve 40, a maximum loaded pressure Pm of the loaded pressures of the hydraulic actuators of the hydraulic device to act in a second control pressure chamber 44*b* of the pressure compensation valve to close the pressure compensation valve, respectively. A pressure receiving area of each control pressure chambers 44*a*, 44*b* is made nearly equal. Since the second control pressure chamber 44*b* of the pressure compensation valve 40 is communicating with the other second control pressure chamber of the other pressure compensation valve each other via the maximum pressure lines 5, no shuttle valve is required in FIG. 7. When a pressure Pz on the upstream side of the directional valve 24 is higher than the pump pressure Pd, the check valve spool 74*e* of the check valve portion 74 is closed. Therefore, in case where the maximum loaded pressure Pm acting on any one of the second control pressure chamber of the pressure compensation valve has lowered, the lowered pressure does not lower the actuator, as similarly seen in the above described conventional hydraulic circuit for a hydraulic device of FIG. 7.

In FIG. 4, in the improved pressure compensation valve 40, the reducing valve spool 43 of the reducing valve portion 42 has a small diameter portion 72*h* extending from a medium diameter portion 72*g* and contactable with and to close the check valve spool 74*e* of the check valve portion 74, further the joining portion between the medium diameter portion 72*g* and the small diameter portion 72*h* is communicated with a tank line 16. As a result, assuming each diameter of the medium and small diameter portions 72*g* and 72*h* of the reducing valve spool 43 denotes as d and d', respectively, a pressure receiving area of the check valve spool 74*e* to close the check valve portion 74 will be made larger by the area $\pi(d^2-d'^2)$ to which the pressure Pz on the upstream side of the directional valve 24 acts to close the check valve portion 74. This area $\pi(d^2-d'^2)$ forms a third control pressure chamber 20*c*,21*c* shown in FIG. 2. On condition the pressure compensation valve 40 is operating, the pressure Pz acting on an area $\pi(d^2-d'^2)$, which is the area of the third control pressure chamber, is equal to the actuator loaded pressure PL plus a differential pressure across the directional valve 24, that is, substantially equal to the actuator loaded pressure PL.

More particularly, the check valve portion 74 of the pressure compensation valve 40 has, inserted into an axial valve bore 74*j*, a check valve spool 74*e* comprising large cut-out grooves 74*b*, small cut-out grooves 74*c*, and a radial hole 74*d* forming a throttle portion communicating with an axial central bore 74*k*. The pump delivery oil pressure Pd communicates with a spool axial valve bore 74*k* through the radial hole 74*d* and then acts on the left side surface of the check valve spool 74*e*. When the pressure Pz on the upstream side of the directional valve 24 is lower than the the pump delivery oil pressure Pd, the check valve spool 74*e* is closed. The reducing valve portion 42 has a the reducing valve spool 43, a pin 73 inserted into an axial central valve bore 72*i*, and a spring 77*d* pressing the reducing valve spool 43 against the check valve spool 74*e*. The pump delivery oil pressure Pd communicated through the radial hole 72*a* forming a throttle portion normally acts on the left surface of the pin 73 inserted into an axial central valve bore 72*i*. The diameter of the pin 73 is made nearly equal to that of the medium diameter portion 72*g*. Although the pressing force of the spring 77*d* is very weak, when the actuator loaded pressure PL and the maximum loaded pressure Pm are zero, the spring 77*d* acts against the reducing valve spool 43, and moves the left surface of the small diameter portion 72*h* to abut and to close the check valve spool 74*e*. The actuator loaded pressure PL is introduced and acts against the joining portion between a large diameter portion 72*m* and the medium diameter portion 72*g* to move the reducing valve spool 43 rightward. The maximum loaded pressure Pm is introduced into the second control chamber 44*b* through the radial hole 72*c* forming a throttle portion and acts against the right surface of the reducing valve spool 43 to move it leftward.

By such an arrangement, this third embodiment of the first aspect of the present invention of the hydraulic circuit for a hydraulic device of FIG. 7 using the improved pressure compensation valve 40 of FIG. 4 performs similar operations as described in the first embodiment shown in FIG. 1.

The operation of the embodiment of the improved pressure compensation valve 40 shown in FIG. 4 as used in a hydraulic device of FIG. 7 (PRIOR ART) will now be described. Firstly, the balance of the forces applied to each of the pressure compensation valves 40 (including the check valve portion 74 and the reducing valve portion 43) will be discussed. When a loaded pressure of the actuator is denoted as PL, and an area of the left surface of he check valve spool 74*e* is denoted as A1, and an area ;$\pi(D_2-d^2)$, which is the area of the third control pressure chamber, which is a differential cross sectional area between the large and medium diameter portions 72*m* and 72*g* of the reducing valve spool 43 denotes as A2, respectively, the force F1 which acts to open the pressure compensation valve rightward may be expressed as:

$$F1 = Pd \cdot A1 + PL \cdot A2 \tag{41}$$

Conversely, when a maximum loaded pressure is denoted as Pm, an area deducting from an area of the right surface of he check valve spool 74*e* an area $\pi d'^2$ denotes as A4, and a cross sectional area of pin 73 denotes as A3, respectively, the force F2 which acts to close the pressure compensation valve leftward may be expressed as:

$$F2 = Pz \cdot A4 + Pm \cdot A2 + Pd \cdot A3 \tag{42}$$

The forces acting in the two opposite directions are balanced during the control by the pressure compensation valve and the results of the expression (41) and the expression (42) are equal, F1=F2; therefore, the following expression may be derived:

$$Pd \cdot A1 + PL \cdot A2 = Pz \cdot A4 + Pm \cdot A2 + Pd \cdot A3 \tag{43}$$

where the acting force of spring 77*d* is ignored since it is extremely weak. The expression (43) may be expressed as:

$$Pz \cdot A4 - PL \cdot A2 = Pd \cdot (A1 - A3) - Pm \cdot A2 \tag{44}$$

Since A2=A1−A3, and by substituting A2=k·A4 (k<1) into the expression (44), and then dividing both members by A4, the following expression may be derived:

$$Pz - k \cdot PL = k \cdot (Pd - Pm) \tag{45}$$

For the purpose of convenience, if k=[1−(1−k)] in the expression (45), the directional valve differential pressure ΔP=Pz−PL may be derived:

$$\Delta P = Pz - PL = k \cdot (Pd - Pm) - PL \cdot (1 - k) \tag{46}$$

by substituting Psp=Pd−Pm into the expression (46), the following expression may be derived:

$$\Delta P = k \cdot Psp - PL \cdot (1 - k) \tag{47}$$

According to the expressions (46) and (47), the directional valve differential pressure ΔP which is a differential pressure across the throttle of the directional valve, is expressed as a value obtained by solving a linear function (47), that is, the directional valve differential pressure ΔP is a function of the pre-set differential pressure Psp set by the spring 18 of pump flow control valve 17, and the loaded pressure PL of the actuator on the downstream side of the pressure compensation valve, further, the respective directional valve differential pressures ΔP decrease and the output flow to the actuator decreases as the actuator loaded pressures PL increase. In other words, a right-down gradient characteristic of the pressure compensation valve is obtained wherein the output flow to the actuator decreases as the actuator loaded pressure PL increases.

Therefore, the above discussions with reference to the first embodiment shown in FIG. 1 all apply to this third embodiment of the first aspect of this invention of the hydraulic device shown in FIG. 4 performing similar effects.

Preferably, a diameter d' of the small diameter portion 72*h* of the reducing valve spool 43 may be selected so that a value of k (k=A2/A4) of the pressure compensation valve communicating with the first hydraulic actuator having the high-load ranges from 0.93 to 0.97, while a value of k of the pressure compensation valve communicating with the second hydraulic actuator having the low-load, ranges from 0.98 to 1.00.

The present invention has been described by way of example, however, the present invention may be embodied in other specific forms without departing from the spirit thereof, and those other specific forms are therefore intended to be embraced therein.

What is claimed is:

1. A hydraulic device comprising:

a variable displacement pump;

first and second hydraulic actuators driven by delivery oil from the pump, each hydraulic actuator having a loaded pressure;

first and second directional valves for controlling the delivery oil flowing into the first and second actuators, respectively;

first and second pressure compensation valves coupled to and for compensating pressures of the first and second directional valves, respectively, the first pressure compensation valve receives an oil pressure on a downstream side of a throttle of the first directional valve coupled to the first pressure compensation valve, a maximum loaded pressure of the loaded pressures of the hydraulic actuators of the hydraulic device, and an oil pressure communicated with the loaded pressure of the first actuator communicating with the first pressure compensation valve, such that the oil pressure on the downstream side of the throttle of the first directional valve to act in a first control pressure chamber of the first pressure compensation valve to open the first pressure compensation valve, and the maximum loaded pressure to act in a second control pressure chamber of the first pressure compensation valve to close the first pressure compensation valve, and the oil pressure communicated with a loaded pressure of the first actuator to act in a third control pressure chamber of the first pressure compensation valve to close the first pressure compensation valve, each pressure receiving area of the first and second control pressure chambers is made the same, while a pressure receiving area of the third control pressure chamber is made far smaller than that of the first control pressure chamber, thereby the first pressure compensation valve decreasing output flow of the delivery oil to the first actuator communicating with the first pressure compensation valve when the loaded pressure of the first actuator is increased;

a constant power control means coupled to the variable displacement pump; and a delivery oil varying means associated with the constant power control means.

2. A hydraulic device according to claim 1, wherein a value obtained by dividing the pressure receiving area of the third control pressure chamber by the pressure receiving area of the first control pressure chamber ranges from 0.03 to 0.07.

3. A hydraulic device according to claim 2, wherein the first pressure compensation valve is located between the first actuator and the first directional valve.

4. A hydraulic device according to claim 2, wherein the first pressure compensation valve is located between the first directional valve communicating with the first pressure compensation valve and a tank.

5. A hydraulic device according to claim 2, wherein the first pressure compensation valve is located between the pump and the first directional valve communicating with the first pressure compensation valve, and the first pressure compensation valves is integrally formed with a check valve portion which normally blocks a reverse flow from the first actuator to the pump and throttles the delivery oil flowing into the first actuator, and a reducing valve portion having a reducing valve spool contactable to close the check valve spool of the check valve portion and capable of reducing a pressure of the pump delivery oil down to a maximum loaded pressure of the loaded pressures of the hydraulic actuators of the hydraulic device.

6. A hydraulic device comprising:

a variable displacement pump;

a first actuator having a high-load and a second hydraulic actuator having a low load, each actuator being driven by delivery oil from the pump;

first and second directional valves having flow control function capable of controlling the delivery oil flowing into each of the actuators, respectively;

first and second pressure compensation valves coupled to and for compensating pressures of the first and second directional valves, respectively, each pressure compensation valve receives an oil pressure on a downstream side of a throttle of the directional valve coupled to the pressure compensation valve, a maximum loaded pressure of the loaded pressures of the hydraulic actuators of the hydraulic device, and an oil pressure communicated with a loaded pressure of the actuator communicating with the pressure compensation valve, such that the oil pressure on the downstream side of the throttle of the directional valve to act in a first control pressure chamber of the pressure compensation valve to open the pressure compensation valve, and the maximum loaded pressure to act in a second control pressure chamber of the pressure compensation valve to close the pressure compensation valve, and the oil pressure communicated with the loaded pressure of the actuator communicated with the pressure compensation valve to act in a third control pressure chamber of the pressure compensation valve to close the pressure compensation valve, each pressure receiving area of the first and second control pressure chambers is made the same, while a pressure receiving area of the third control pressure chamber is made far smaller than that of the first control pressure chamber, thereby the pressure compensation valve decreasing output flow of the delivery oil to the respective actuator when the loaded pressure of the actuator communicating with the pressure compensation valve is increased;

a constant power control means coupled to the variable displacement pump; and a delivery oil varying means associated with the constant power control means.

7. A hydraulic device according to claim 6, wherein a rate of the decreasing the output flow of the delivery oil of the one of the pressure compensation valves communicating with the one of the actuators having a high-load is made greater than that of the one of the pressure compensation valves communicating with the one of the actuators having a low-load.

8. A hydraulic device according to claim 7, wherein a value obtained by dividing the pressure receiving area of the third control pressure chamber by the pressure receiving area of the first control pressure chamber of the one of the pressure compensation valves communicating with the one of the actuators having a high-load ranges from 0.03 to 0.07, while a value obtained by dividing the pressure receiving area of the third control pressure chamber by the pressure receiving area of the first control pressure chamber of the one of the pressure compensation valves communicating with the one of the actuators having a low-load ranges from 0 to 0.02.

9. A hydraulic device according to claim 8, wherein each pressure compensation valve is located between the directional valve communicating with the pressure compensation valve and a tank, respectively.

10. A hydraulic device according to claim 8, wherein each pressure compensation valve is respectively located between the actuator and the directional valve both communicating with the pressure compensation valve.

11. A hydraulic device according to claim 8, wherein each pressure compensation valve is located between the actuator communicating with the pressure compensation valve and the pump, respectively, and each pressure compensation valve is integrally formed with a check valve portion which normally blocks a reverse flow from the actuator to the pump and throttles the pump delivery oil flowing into the actuator, and a reducing valve portion having a reducing valve spool contactable to close the check valve spool of the check valve portion and capable of reducing a pressure of a pump delivery oil down to the maximum loaded pressure, respectively.

12. A hydraulic device comprising:

a variable displacement pump;

a first actuator having a high-load and a second hydraulic actuator having a low-load, each actuator being driven by delivery oil from the pump;

first and second directional valves having flow control function capable of controlling the delivery oil flowing into the first and second actuators, respectively;

first and second pressure compensation valves coupled to and for compensating pressures of the first and second directional valves and located between the directional valve communicating with the pressure compensation valve and a tank, respectively, each pressure compensation valve receives an oil pressure on a downstream side of a throttle of the directional valve coupled to the pressure compensation valve, and a maximum loaded pressure of the loaded pressures of the hydraulic actuators of the hydraulic device, respectively, such that the oil pressure on the downstream side of the throttle of the directional valve to act in a first control pressure chamber of the pressure compensation valve to open the pressure compensation valve, and the maximum loaded pressure to act in a second control pressure chamber of the pressure compensation valve to close the pressure compensation valve, respectively, a value obtained by dividing a pressure receiving area of the first control pressure chamber by a pressure receiving area of the second control pressure chamber of the pressure compensation valve communicating with the first hydraulic actuator having the high-load, ranges from 0.93 to 0.97, while a value obtained by dividing a pressure receiving area of the first control pressure chamber by a pressure receiving area of the second control pressure chamber of the pressure compensation valve communicating with the second hydraulic actuator having the low-load, ranges from 0.98 to 1.00, thereby the rate of the decreasing output flow of the delivery oil to actuator having the high-load when the loaded pressure of the pressure compensation valve communicating with the high-load actuator is increased is made greater than that of the pressure compensation valve communicating with the actuator having the low-load;

a constant power control means coupled to the variable displacement pump; and a delivery oil varying means associated with the constant power control means.

* * * * *